United States Patent [19]

Russell

[11] 4,443,181

[45] Apr. 17, 1984

[54] DRAFT CONTROL SYSTEM

[76] Inventor: Robert J. Russell, 1332 Lymric Way, Bakersfield, Calif. 93309

[21] Appl. No.: 372,326

[22] Filed: Apr. 27, 1982

Related U.S. Application Data

[63] Continuation-in-part of Ser. No. 124,089, Feb. 25, 1980, Pat. No. 4,341,344.

[51] Int. Cl.[3] ..... F23N 3/00; F23N 5/00

[52] U.S. Cl. ..... 431/6; 236/15 E; 236/45; 431/20; 431/76

[58] Field of Search ..... 236/45, 16, 15 E; 110/163; 126/292, 296; 137/614.2; 431/20, 76, 6

[56] References Cited

U.S. PATENT DOCUMENTS

| | | | |
|---|---|---|---|
| 1,320,298 | 10/1919 | Waldorn | 236/45 |
| 1,402,083 | 1/1922 | Morton | 236/45 |
| 1,775,065 | 9/1930 | Brown | 236/45 |
| 1,848,850 | 3/1932 | Sturgis | 236/45 |
| 1,973,997 | 9/1934 | Roberts | 236/45 |
| 2,126,994 | 8/1938 | Irsch et al. | 236/19 |
| 2,130,491 | 9/1938 | Gilliland | 110/163 X |
| 2,179,940 | 11/1939 | Lawson | 236/45 |
| 2,186,354 | 1/1940 | Whetstine | 236/45 |
| 2,272,468 | 2/1942 | Lange et al. | 236/45 |
| 2,291,018 | 7/1942 | Bachmann | 236/45 |
| 2,297,757 | 10/1942 | Field, Jr. | 236/45 |
| 2,335,740 | 11/1943 | Cole | 236/45 |
| 2,388,253 | 11/1945 | Dady | 236/45 |
| 2,396,277 | 3/1946 | Edwards | 110/147 |
| 2,433,749 | 12/1947 | Field, Jr. | 236/45 |
| 2,435,166 | 1/1948 | Stephenson | 236/45 |
| 2,441,398 | 5/1948 | D'Elia | 236/45 |
| 2,539,815 | 1/1951 | Dady | 236/45 |
| 2,555,687 | 6/1951 | Field, Jr. | 236/45 |
| 2,652,200 | 9/1953 | Field | 236/45 |
| 2,687,256 | 8/1954 | Puffer | 236/45 |
| 2,743,056 | 4/1956 | Hubbard | 236/45 |
| 2,783,756 | 3/1957 | Crozier | 236/45 |
| 3,070,312 | 12/1962 | Steinen | 236/45 |
| 3,208,670 | 9/1965 | Pfister | 236/45 |
| 3,297,251 | 1/1967 | Pfister | 236/45 |
| 3,362,634 | 1/1968 | Steinen | 236/45 |

*Primary Examiner*—William E. Tapolcai

*Attorney, Agent, or Firm*—Knobbe, Martens, Olson, Hubbard & Bear

[57] ABSTRACT

A draft control system for furnaces comprises an auxiliary channel in communication both with ambient air and the flue of the furnace, a main draft control means for regulating the entrance of ambient, auxiliary draft air into the flue, and auxiliary draft control means mounted in the auxiliary channel for dampening the effect of extreme changes in external conditions on the main draft control means. Thus, uniform draft and efficient combustion is maintained in the furnace under a wide variety of conditions. The main draft control means comprises counter-balanced draft control plates which are initially set in an open position so that they can either open or close in order to efficiently regulate the draft in the flue. The auxiliary draft control means comprises, in one embodiment, an isolation damper plate rotationally mounted in the auxiliary channel, or, in a second embodiment, a set of louvred panels. The position of the auxiliary draft control means is automatically regulated by a pneumatic control device responsive to the efficiency of furnace combustion.

4 Claims, 3 Drawing Figures

DRAFT CONTROL SYSTEM

CROSS-REFERENCE TO RELATED APPLICATION

This application is a continuation-in-part of application Ser. No. 124,089 filed Feb. 25, 1980, entitled "Automatic Draft Controller", now U.S. Pat. No. 4,341,344, issued July 27, 1982.

BACKGROUND OF THE INVENTION

Gas, coal and oil burning furnaces are very prevalent in our society and have many industrial, commercial and residential applications. For example, in the refining of oil to produce gasoline and other petroleum products, crude oil must be heated in large outdoor furnaces as a part of the refining or "cracking" process. It is common in oil refineries for as many as 25 to 50 furnaces to be in constant 24-hour operation. These furnaces consume massive amounts of oil and natural gas. In fact, the annual fuel costs incurred in operating each one of these furnaces often exceeds $200,000, depending upon the size of the furnace. Therefore, small improvements in the efficiency of the operation of the furnace can yield large savings in fuel cost.

The efficiency of the furnaces' operation can be determined by measuring the amount of fuel or air which is not consumed in the combustion process. Perfect combustion, the most efficient form of combustion, occurs when the fuel and air are completely consumed, and only the gaseous by-products remain. Thus, under perfect combustion conditions, there is a 0% excess oxygen in the combustion by-products. Naturally, the more efficient the combustion, the less fuel which is consumed in heating the crude oil during the cracking process. In order to avoid inefficient excess oxygen conditions during the furnaces' combustion, it is essential that the amount of air entering the furnace, or in other words the "draft", not exceed the amount of draft needed for perfect combustion. Otherwise, the furnace will be operating inefficiently.

In contrast to the problem of excess oxygen caused by excessive draft conditions, perfect combustion can also be prevented by the presence of excess fuel, or in other words insufficient draft. Thus, the draft conditions in a furnace are extremely important in maintaining its efficient operation and the conservation of fuel. Furthermore, the maintenance of even, uniform draft in the furnace, under both mild and extreme changes in furnace operating conditions, is critical to combustion efficiency.

Heretofore, improper draft control has been the major contributing factor in inefficient furnace operation. Changes in the draft volume or velocity may be caused by many external factors, such as the amount of crude oil fed into the furnace or changes in the ambient condition surrounding the furnace. For example, an increase in the furnace's fuel consumption, necessitated by an increase in the crude feed rate, can produce oxygen-deficient combustion, resulting in dark smoke and increased pollutant emissions. Furthermore, a strong wind blowing across the top of the stack of flue of the furnace will create a low-pressure area at that point, increasing the amount of draft and resulting in excess oxygen conditions and inefficient combustion. Also, a decrease in temperature of the surrounding air will increase its density, again resulting in excess oxygen conditions.

It is common to compensate for these changes in draft intensity by providing a furnace with a damper plate in the flue to control the velocity of the draft. However, these flue dampers must be manually operated. Therefore, their position must be adjusted with each change in furnace operating conditions, whether it be a change in fuel rate or ambient conditions. This method of draft control increases the labor costs associated with furnace operation. Furthermore, since these flue dampers are exposed to the hot flue gases, their bearings deteriorate very rapidly, causing the damper to stick and become inoperable.

Another prior approach was to mount a damper plate in a channel in communication with the flue but not directly exposed to the hot flue gases. Although the damper plates of the prior art were somewhat efficient in controlling draft intensity, they have not been sufficiently sensitive to changes in draft conditions, especially extreme changes in operating conditions. For example, prior art plates were not able to permit the flow of ambient air into the flue until the pressure differential across the plate was sufficient to overcome its own weight. Therefore, the response of prior damper plates was slow, permitting inefficient draft conditions to persist. On the other hand, a plate whose weight was only barely sufficient to maintain it in a closed position flapped widely and uncontrollably in response to extreme changes in draft conditions. For example, a strong wind blowing across the top of the flue caused prior damper plates to open and close very widely and rapidly, preventing the even, uniform control of the draft.

A further substantial disadvantage associated with the prior damper plates is that they normally operate in a closed position, totally preventing outside, auxiliary draft air from entering the flue. Under these conditions, if the velocity of the draft should be increased (for example, when the fuel consumption of the furnace is increased), the damper plate is unable to permit more air to be drawn in at the base of the furnace. Thus, insufficient oxygen conditions exist, resulting in inefficient furnace operation.

SUMMARY OF THE INVENTION

The draft control system of the present invention overcomes the shortcomings of the prior art by providing both main and auxiliary draft control means which maintain efficient control over the combustion in the furnace regardless of both mild and extreme changes in furnace operating conditions, both slight and extreme. In other words, the present draft control system provides a uniform draft in the furnace, even under extreme changes in ambient conditions or changes in the rate of fuel consumption of the furnace. Thus, the result is a substantial savings in fuel consumption. In addition, since inefficient excess oxygen conditions are minimized, there is reduction in pollutant emissions.

The present draft control system is comprised of an auxiliary channel in communication with the main flue of the furnace, a draft box mounted at the end of the auxiliary channel and open to ambient air, a main draft control means mounted in the draft box, and an auxiliary draft control means mounted in the auxiliary channel. The main draft control means, which preferably is comprised of one or more counter-balanced draft control plates rotationally mounted at the mouth of the draft box, is sufficient to maintain uniform draft control under slight to moderate changes in operating conditions. That is, if the furnace operating conditions vary moderately due to light winds, changes in atmospheric pressure, or small changes in the rate of fuel consumption, the present main draft control means provides an even draft control for efficient combustion conditions.

The auxiliary draft control means of the present invention is necessary to maintain uniform draft under extreme conditions, such as high winds, substantial changes in fuel consumption, etc. The auxiliary draft control means acts as an isolation damper to either selectively increase or decrease the amount of ambient air, or "auxiliary draft", entering the flue. In essence, the auxiliary draft control means throttles the auxiliary draft to permit the main draft control means to operate more efficiently in maintaining control under sustained, extreme conditions. In addition, the auxiliary draft control means assists the main draft control means in providing uniform draft control under transient operating conditions. The auxiliary draft controller cooperates with the main draft controller to provide uniform draft conditions, thereby reducing fuel consumption and pollutant emissions over a wide spectrum of combustion conditions.

In one embodiment, the auxiliary draft control means comprises an isolation damper plate rotatively mounted in the auxiliary channel. In another embodiment, the isolation damper is comprised of a series of louvered panels, which permits the use of a very short auxiliary channel. Although the auxiliary draft control means can be manually operated, preferably, it is automatically operated by means of a pneumatic control system responsive to an oxygen analyzer mounted on the furnace. The analyzer measures the efficiency of combustion and adjusts the position of the auxiliary draft control plate accordingly.

The advantages of the present draft control system are substantial. An unattended oil refinery furnace typically operates under excess oxygen conditions of 6–9%. Even with frequent manual adjustment in response to changes in operating conditions (which adjustment is necessary on a daily basis), the best practical draft conditions for such a furnace is 4–5% excess oxygen. The amount of excess oxygen in the furnace is a guage of the efficiency of the combustion therein; the less oxygen present in the combustion by-products, the greater the efficiency and fuel conservation. With the present draft control system, an average of only 2% excess oxygen can be easily maintained without the necessity of adjustments of any type. In addition, the present invention is capable of sustaining levels of excess oxygen of less than 1% for several days at a time. Accordingly, approximately a 10% savings in annual fuel consumption can be realized, resulting in a savings of more than $20,000 per year for a single heater. In an average refinery of 25 furnaces, this yields an annual savings of $500,000. In addition, in at least one furnace, an 18% fuel savings was recorded.

Furthermore, with the present draft control system, since less oxygen remains in the combustion by-products, there is approximately a 30% reduction in nitrous oxides ($NO_x$) emissions and a significant reduction in sulphur oxides ($SO_x$) emissions.

DETAILED DESCRIPTION OF THE INVENTION

Figure 1:
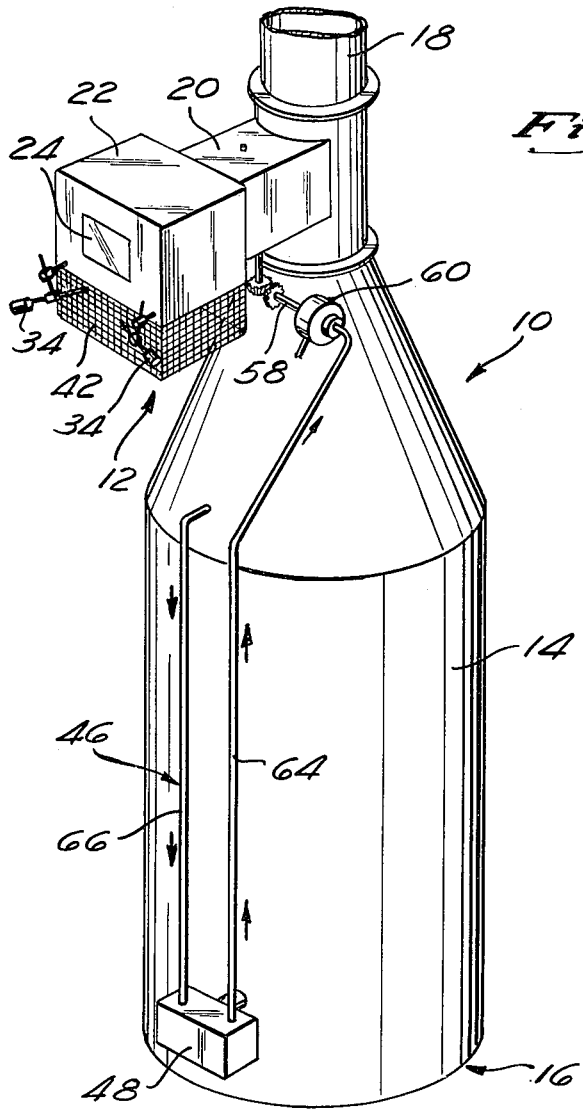
FIG. 1 is a perspective view of the draft control system of the present invention mounted on the flue of of a large oil refinery furnace.

FIG. 1 illustrates a typical oil refinery furnace 10 on which the draft control system 12 of the present invention has normal application. However, it should be pointed out that the principles of the present invention can be applied equally well to heaters and furnaces of all types. The furnace 10 comprises a large body 14 within which combustion occurs. The body 14 contains a heat exchanger (not shown) through which crude oil flows during the refining process. The draft air of the furnace enters at the base 16 of the body 14. After combustion, the hot by-products and gases of combustion rise rapidly through the flue 18 of the furnace 10 to create a natural draft. The present invention can also be applied to furnaces having forced-air draft.

The draft control system 12 of the present invention comprises, in part, an auxiliary channel 20 which is mounted on the flue 18 of the furnace 12 so as to be in communication with the interior of the flue 18. Thus, the present draft control system is not directly exposed to hot flue gases. At one end of the auxiliary channel 20 is mounted a large draft box 22 which is in communication with outside ambient air. Ambient air enters the flue 18 through the draft box 22 and the auxiliary channel 20 in order to provide an auxiliary draft for maintaining control of the natural draft in the furnace at efficient levels. That is, cool ambient air enters the bottom of the draft box 22 and flows through the auxiliary channel 20 into the flue 18, thus providing an "auxiliary draft". Under operating conditions where the natural draft in the furnace is excessive, thus leading to excess oxygen and inefficient combustion conditions, this auxiliary draft serves to slow down the velocity of the natural draft and to decrease its volume, thereby providing efficient combustion conditions. On the other hand, when the natural draft is deficient, such as when the fuel consumption rate of the furnace is increased, it is desirable for the auxiliary draft to decrease thereby increasing the natural draft and again yielding efficient combustion.

As shown in FIG. 1, the draft box 22 can also be provided with an observation port 24 for viewing the operation of the draft control system 12 of the present invention.

Figure 2:
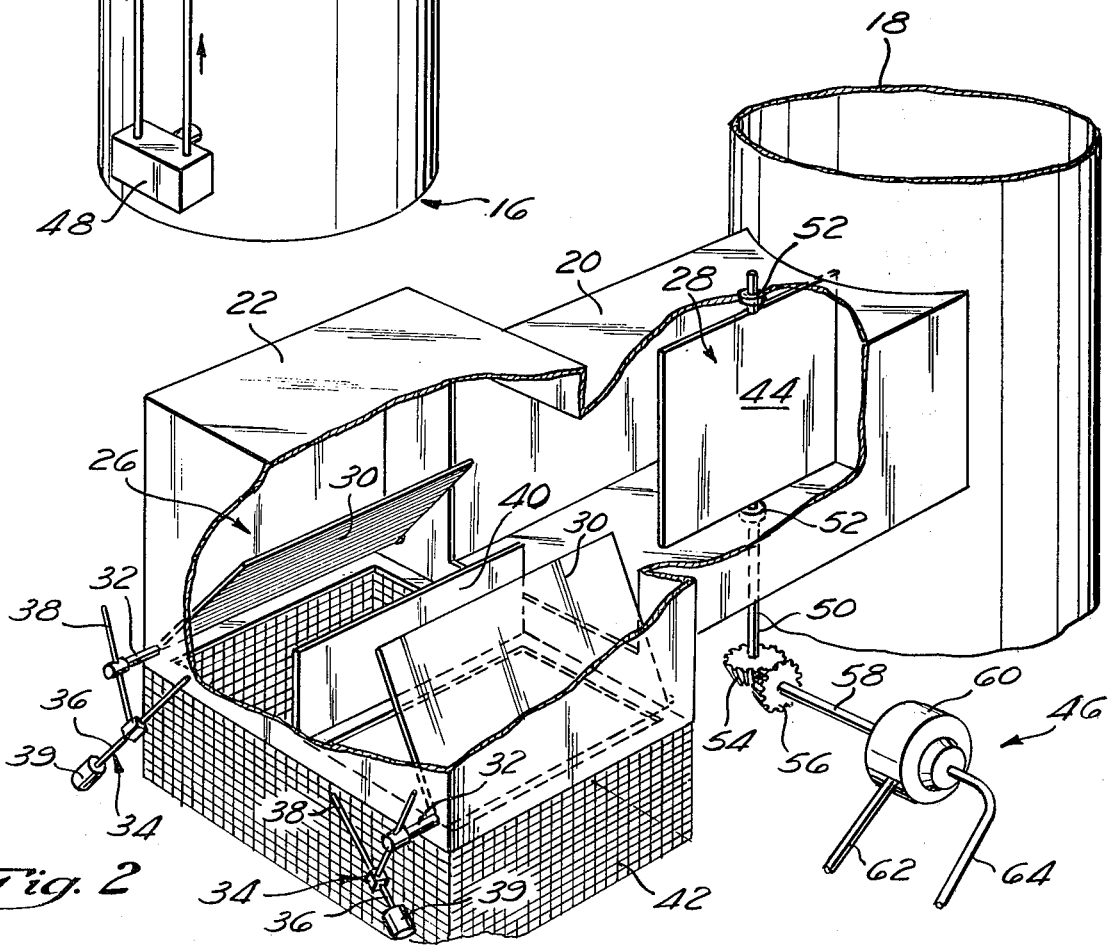
FIG. 2 is a partial perspective view of the present draft control system illustrating the draft box and the auxiliary channel partially broken away to view the main and auxiliary draft control means.

FIG. 2 illustrates the details of the main and auxiliary draft control means 26 and 28, respectively. In one embodiment, the main draft control means 26 comprises a pair of plates 30 rotatively mounted along one edge 32 and provided with counter-weight devices 34. The construction and operation of these counter-balanced draft control plates 30 are described in more detail in a co-pending application, Ser. No. 124,089, filed Feb. 25, 1980, now U.S. Pat. No. 4,341,344 issued July 27, 1982, and entitled "Automatic Draft Controller".

The main draft control means 26 comprise one or more draft control plates 30 horizontally or vertically mounted in the mouth of the draft box 22. Each draft control plate 30 is provided with both horizontal and vertical counter-balance devices, 36 and 38, respectively, which are utilized to adjust the movements of the plate 30 in response to changes in pressure differential across it. The horizontal counter-balance device 36 is used to set the plate 30 in an initially open position so that it can either open or close to regulate the entrance of ambient, auxiliary draft air into the flue 18, thus maintaining uniform draft conditions. The vertical counter-balance device 38 is utilized to adjust the sensitivity of the plate 30 by varying its rate of change in position in response to changes in pressure or other conditions.

A significant aspect of the main draft control means 26 is that it utilizes more than one such draft control plate 30 to increase the sensitivity of draft regulation. For example, in a dual plate system, inefficiencies in one plate can be compensated for by the other plate. In the case of an external wind, if one plate is sucked downward into a closed position, a high pressure zone is created under the other draft control plate which forces it to open even wider, thereby compensating for the closing of the first plate. Furthermore, in a multiple plate arrangement, each individual plate is smaller and lighter and therefore more sensitive to changes in pressure differential, resulting in more efficient and uniform draft control.

The counter-balance devices 36 used in conjunction with each main draft control plate 30 are used to set the plate 30 initially in a partially open position. Thus, when it is necessary to increase the amount of auxiliary draft, each draft control plate 30 simply opens wider, admitting a greater amount of ambient air into the draft box 22. On the other hand, when it is necessary to decrease the amount of auxiliary draft, such as when the fuel consumption of the furnace increases, the draft control plate 30 automatically closes, thereby cutting off the amount of ambient air entering the flue 18. Thus, the main draft control means 26 of the present invention provides uniform draft control and efficient combustion by quickly responding to most changes in operating conditions.

The counter-balancing devices 36 and 38 provide quick response in draft control to most changes in operating conditions. The weight of the counter-weight 39 can be determined by multiplying the area of each plate 30 times the pressure created by the draft in the furnace plus the weight of the plate itself. A counter-weight 39 weighing this amount is then placed on a rod 36 an equal distance as the width of the plate 30 on the opposite side of the plate axis 32.

The draft control system 12 of the present invention must be carefully sized for each particular furnace on which it is to be mounted. For example, the draft capacity of the furnace dictates the size of auxiliary channel 20 and fuel area of draft control plates 30. Furthermore, the load, or feed rate, at which the furnace is running must be guaged to the size of the draft control system. For example, a furnace which runs at far below its design load of fuel consumption needs a larger draft control system than a heater which normally runs at design conditions. This is because the draft control system diverts ambient air into the flue 18 that otherwise would enter through the burners at the base 16 of the furnace. As a furnace runs at lower load rates, more and more ambient air must enter through the draft control system 12 into the flue 18. Therefore, each furnace must be checked to ensure that the proper size draft control system 12 is installed.

The draft control system 12 is also provided with means for reducing the turbulence of the ambient air entering the flue 18 as auxiliary draft. A vertical wall 40 is situated between the two draft control plates 30 in order to serve as a baffle for turbulence. In otherwords, this baffle plate 40 smoothes out the turbulence in the incoming air and provides even, uniform flow of auxiliary draft air into the flue 18, thereby providing enhanced draft control and efficient combustion conditions. Preferably, the height of the baffle 40 is approximately as high as the length of each damper plate 30. In addition, the bottom of the draft box 22 is provided with a skirt 42 (FIGS. 1 and 2) which surrounds the opening or mouth of the draft box 22. The openings in the skirt 22, which can be constructed from any appropriate material (preferably, expanded metal), allows ambient air to pass while the material itself smoothes out the turbulence. Again, the result is enhanced, uniform draft with improved draft stability and control.

Figure 3:
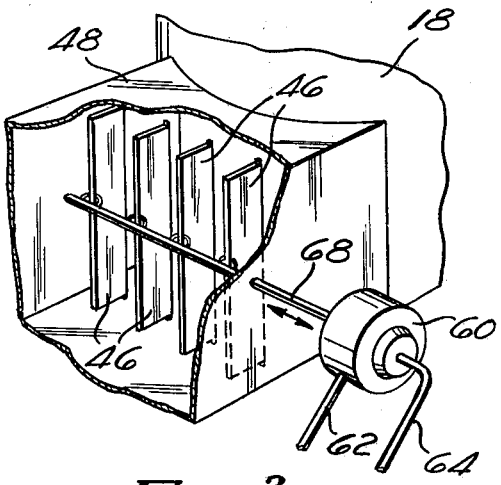
FIG. 3 is a partial perspective view of the auxiliary channel broken away to illustrate a louvered auxiliary draft control means.

FIG. 2 also illustrates the auxiliary draft control means 28 which is mounted in the auxiliary channel 20. In one embodiment, the auxiliary draft control means 28 comprises a square isolation damper plate 44, although other geometric shapes, such as rectangular or circular, can serve equally as well. In addition, as illustrated in FIG. 3, the auxiliary draft control means can also comprise a series of louvered panels 46 which are necessary in a very short auxiliary channel 48. That is, where the transition between the main flue 18 of the furnace 12 and the draft box 22 is very short, the louvered isolation damper 46 of FIG. 3 reduces the path necessary to open and close the auxiliary channel 48.

The auxiliary draft control plate 44 serves as an isolation damper to selectively open or close the auxiliary channel 20 and to provide enhanced control over the amount of auxiliary draft air entering the flue 18. In the wide open position, the main draft control means 26 rapidly responds to slight to moderate changes in operating conditions in order to provide efficient draft control. Where operating conditions become extreme, whether transient or sustained, the main draft control means 26 may be subject to uncontrolled movement causing variations in the correct amount of auxiliary draft for efficient combustion. Such extreme conditions may occur, for example where a very high wind is blowing over the top of the furnace which would cause the draft control plates 30 to flap rapidly, breaking the even control over the auxiliary draft. Under these conditions, the auxiliary draft control means 28 is partially closed in order to dampen or dilute the effect of the strong wind on the main draft control plates 30. In effect, the auxiliary draft control means 28 chokes or throttles the auxiliary draft in order to regulate the responsiveness of the main draft control means 26 to changes in operating conditions. In other words, it regulates (e.g. dampens or dilutes) the effect of draft-induced differential pressures acting on the main draft control means 26. Thus, the main 30 plates are then able to provide even, controlled draft and efficient combustion conditions.

The position of the isolation damper plate 44 is adjusted according to the operating conditions. For example, if a strong steady wind is blowing, the isolation damper plate 44 may have to be adjusted to approximately a 45° position, or possibly even further, in order to nearly close the auxiliary channel 22. If the operating conditions are transient, such as in the case of intermittent gusts, then the isolation damper plate 44 may have to be only partially closed, permitting a wide range of operation for the main draft control plates 30.

In the method of the present invention, the air regulators (not shown) on the burners (not shown) of the furnace 12 are initially set in a 50% open position. The auxiliary damper plate 44 is then set at an approximate 45° angle while the main draft control plates 30 are set at approximately a 40% open position. The furnace 12 is then fired-up and the excess oxygen conditions in the combustion are briefly monitored. The air regulators on the burners are then opened in order to achieve the most efficient excess oxygen conditions possible. The furnace 12 can then be left virtually unattended to provide uniform, efficient draft control. If extreme changes in operating conditions occur, the angle of the auxiliary damper plate 44 is adjusted accordingly.

In order to permit automatic adjustment in the auxiliary draft control plate 44, the present invention includes a pneumatic control system 46, shown in FIGS. 1 and 2, responsive to an oxygen analyzer 48. The oxygen analyzer 44 senses the amount of excess oxygen in the by-products of the furnace combustion and automatically adjusts the position of the auxiliary draft control plate 44 to achieve uniform draft control. As shown in FIG. 2, the auxiliary draft control plate 44 is rotatively mounted about a central axis 50 which turns in the bearings 52. The lower end of the axis is provided with a gear 54 which meshes with a corresponding gear 56 mounted on a linkage arm 58. The rotational movement of the linkage arm 58 is controlled by a pneumatic regulator 60 which is in turn controlled by a supply of air provided through conduit 62 from a suitable source (not shown). The air regulator 60 is also controlled by the signal air which is supplied from the oxygen analyzer 48 through conduit 64.

As shown in FIG. 1, the analyzer 48 senses the excess oxygen on top of the furnace body 14 by means of a conduit 66. It then provides a correct amount of signal air to adjust the position of the auxiliary draft control plate 44 for efficient oxygen conditions. With the oxygen analyzer set for the desired level of excess oxygen, the pneumatic control system will then control draft at that level regardless of changes and conditions. It should also be pointed out that other control system others can also serve equally as well.

In the louvered auxiliary draft control plate 46 of FIG. 3, an extended linkage arm 68 from the pneumatic regulator 60 translates laterally to open and close the louvered panels 46.

What is claimed is:

1. A draft control system for maintaining uniform, controlled draft in a furnace, comprising:

an auxiliary channel in communication with the flue of said furnace;

main draft control means mounted in said auxiliary channel for regulating auxiliary draft entering the flue of said furnace to maintain uniform draft control in said furnace;

auxiliary draft control means mounted in said auxiliary channel for permitting said main draft control means to maintain uniform, controlled draft control under extreme operating conditions, said auxiliary draft control means providing means for selectively opening or closing said auxiliary channel to damper the effect of said extreme changes in operating conditions on said main draft control means; and means for automatically controlling the position of said auxiliary draft control means in response to the efficiency of combustion in said furnace, and wherein said automatic controlling means comprises a pneumatic control system responsive to an oxygen analyzer mounted on said furnace.

2. The draft control system of claim 1 wherein said pneumatic control system automatically adjusts the position of said auxiliary draft control means.

3. A draft control system for maintaining uniform, controlled draft in a furnace, comprising:

an auxiliary channel in com main draft control means mounted in said auxiliary channel for regulating auxiliary draft entering the flue of said furnace to maintain uniform draft control in said furnace;

auxiliary draft control means mounted in said auxiliary channel for permitting said main draft control means to maintain uniform, controlled draft control under extreme operating conditions, said auxiliary draft control means providing means for selectively opening or closing said auxiliary channel to dampen the effect of said extreme changes in operating conditions on said main draft control means; and means for decreasing the turbulence of incoming auxiliary draft air, wherein said turbulence decreasing means comprises a skirt surrounding the opening of said auxiliary channel.

4. A method for controlling uniform draft in a furnace having main and auxiliary draft control means mounted in an auxiliary channel in communication with the flue of said furnace, said furnace having burners with air regulators thereon, said method comprising the steps of:

setting the air regulators on the burners of said furnace in a 50% open position;

adjusting said auxiliary draft control means to an approximately half open position;

initially setting the main draft control means in an open position;

firing the furnace to begin combustion;

monitoring the amount of excess oxygen in the by-products of said combustion;

opening the air regulators on the burners of said furnace to provide the desired level of efficient excess oxygen; and adjusting the position of said auxiliary draft control means in response to changes in operating conditions to assist said main draft control means in maintaining uniform draft conditions.

* * * * *